United States Patent [19]

Mossbach

[11] Patent Number: 4,590,917

[45] Date of Patent: May 27, 1986

[54] SPACE HEATER FOR SMALL ROOMS

[75] Inventor: Wilhelm Mossbach, Kirchseeon, Fed. Rep. of Germany

[73] Assignee: Philipp Kreiss GmbH & Co. Truma-Geratebau, Putzbrunn, Fed. Rep. of Germany

[21] Appl. No.: 618,964

[22] Filed: Jun. 11, 1984

[30] Foreign Application Priority Data

Jun. 10, 1983 [DE] Fed. Rep. of Germany ..... 3321116

[51] Int. Cl.[4] ..... F24C 3/00

[52] U.S. Cl. ..... 126/90 R

[58] Field of Search ..... 126/110 B, 99 R, 90 R, 126/91 R, 116 R, 116 B

[56] References Cited

U.S. PATENT DOCUMENTS

| | | | |
|---|---|---|---|
| 610,037 | 8/1898 | Evans | 126/99 R |
| 727,750 | 5/1903 | Cooper | 126/99 R |
| 801,824 | 10/1905 | Berry | 126/99 R |

FOREIGN PATENT DOCUMENTS

| | | | |
|---|---|---|---|
| 2139504 | 2/1973 | Fed. Rep. of Germany . | |
| 1254614 | 1/1961 | France | 126/110 B |

*Primary Examiner*—Carroll B. Dority, Jr.

*Attorney, Agent, or Firm*—Karl F. Ross; Herbert Dubno

[57] ABSTRACT

A space heater for small rooms, e.g. house trailers or ship's cabins, comprises an undulating heat exchanger centered on a vertical axis and a combustion pipe surrounded thereby. A burner enters the lower end of the combination pipe whose upper end is closed except for a number of lateral openings communicating with outwardly closed smoke channels of the undulating heat exchanger which alternate with outwardly open air channels. An outer peripheral wall, spacedly surrounding the heat exchanger, forms with its air channels an annular conduit for the conveyance of ambient air entering that conduit near its bottom and leaving it at its top.

10 Claims, 2 Drawing Figures

SPACE HEATER FOR SMALL ROOMS

FIELD OF THE INVENTION

My present invention relates to a space heater for small rooms, e.g. those in moving structures such as house trailers or ship's cabins.

BACKGROUND OF THE INVENTION

A known space heater of this type, described in German published specification DE-OS No. 21 39 504, is formed as a unitary elements by compression or injection molding with a generally cylindrical jacket which is closed at its top by an approximately spherical cap and has vanes projecting from its inner and outer peripheral surfaces as indirect-heating elements. A cylindrical combustion pipe projects into the open lower end of the jacket and is provided over its entire height with wall apertures, terminating at a substantial distance from the end cap of the heat exchanger. Also, the ends of the inner vanes lie at a considerable distance from the combustion pipe. Such a structure requires a large outer diameter and is difficult to mold or cast, especially when the number of vanes is high for a maximum heat-transfer rate. This proliferation of vanes with indirect heating effect, on the other hand, goes at the expense of the unobstructed surface of the jacket which alone enables a direct heat exchange between the hot interior and the colder exterior.

OBJECT OF THE INVENTION

The object of my present invention, therefore, is to provide an improved heat exchanger for a space heater of the general type referred to which can be manufactured in a simple manner and has a particularly high specific heat-exchange rate.

SUMMARY OF THE INVENTION

I realize this object, in accordance with my present invention, by coaxially surrounding a generally cylindrical combustion pipe, normally centered on a vertical axis and provided with an open lower end, with a heat exchanger constituted by a jacket of undulating cross-section over at least a major part of its height to form a multiplicity of inwardly open first vertical channels alternating with as many outwardly open second vertical channels. The first channels communicate near their upper ends with the combustion pipe and are connected at their lower ends with an exhaust, being thus traversed by combustion gases whose heat is transferred to air passing through the outer channels which communicate at least at their upper and lower ends with the surrounding atmosphere. It will therefore be convenient to refer to the inner channels as smoke channels and to the outer ones as air channels.

The air channels may be completely exposed or, according to the preferred embodiment described hereinafter, may be shielded by a generally cylindrical outer wall forming with the undulating jacket an annular conduit which is open at the bottom and at the top to the surrounding atmosphere for enabling a circulation of ambient air therethrough. Such an outer wall prevents persons or animals in the room from coming into contact with the heated jacket.

Advantageously, pursuant to a further feature of my invention, the combustion pipe is in direct contact with the jacket undulations and thereby separates the smoke channels from one another. These smoke channels, which preferably are substantially narrower than the air channels, then form ducts of small cross-section bounded on three sides by heat-transmitting wall portions and on their fourth side by a heat-supplying wall portion for a very efficient thermal exchange. The radial depth of the undulations may range between substantially one-fifth and one-half of the outer jacket radius.

BRIEF DESCRIPTION OF THE DRAWING

The above and other features of my invention will now be described in detail with reference to the accompanying drawing in which.

SPECIFIC DESCRIPTION

Figure 1:
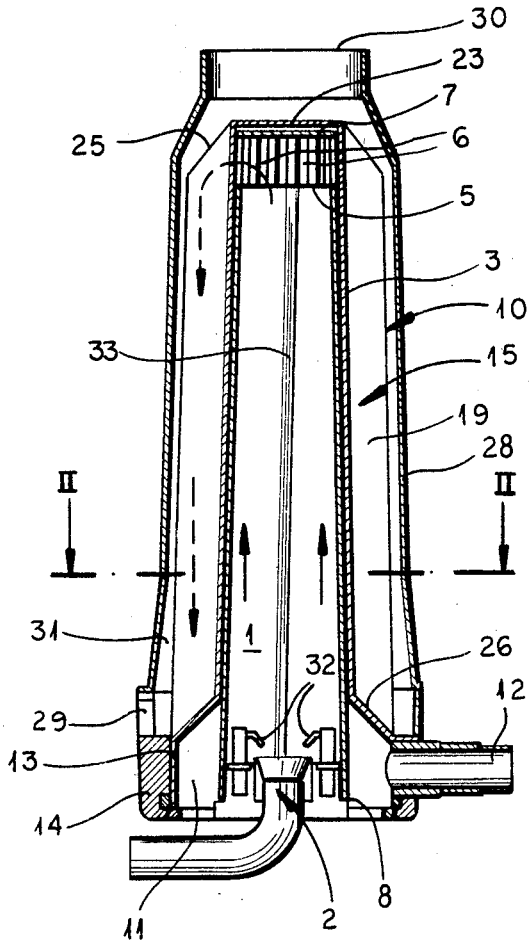
FIG. 1 is a sectional elevational view of a space heater according to my invention.
Figure 2:
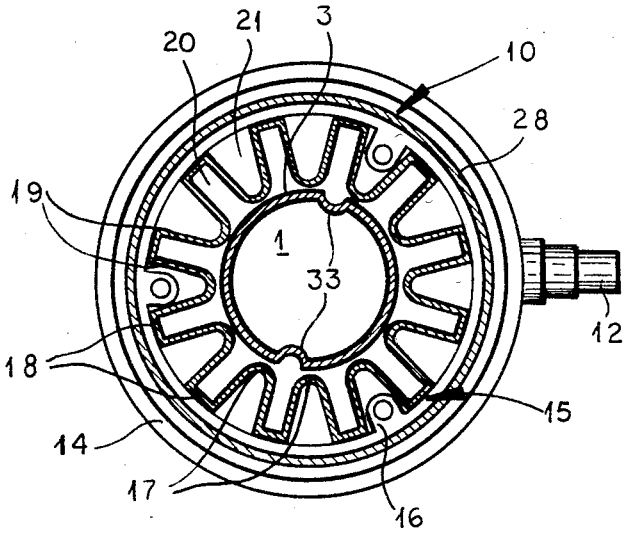
FIG. 2 is a cross sectional view taken on the line II—II of FIG. 1.

The space heater shown in the drawing comprises a firebox 1 at the lower end of a metallic combustion pipe 3 of slightly frustoconical, upwardly tapering configuration. A grid 8 supporting the head of a burner 2 centers the pipe 3 with reference thereto and also carries several igniters 32 whose external connections, like those of burner 2, have not been illustrated. Pipe 3 is entirely surrounded by a heat exchanger, generally designated 10, comprising a metallic jacket 15 of undulating shape as best seen in the cross-sectional view of FIG. 2. The undulations of this jacket define a multiplicity of peripherally spaced smoke channels 20, bounded by nearly parallel wall portions 19, alternating with outwardly diverging air channels 21 whose rounded inner boundaries 17 are in direct contact with pipe 3. The outer boundaries 18 of smoke channels 20, which like the contact lines of boundaries 17 of channels 21 lie on an imaginary frustoconical surface, are separated by a small annular clearance from a metallic outer wall 28 defining with channels 21 an annular conduit for the circulation of ambient air entering a downwardly widening lower part 31 of this conduit through an opening 29 in a base 14 of the heat exchanger. That base is provided with several lugs 16 enabling it to be fastened to an underlying floor plate or the like. Wall 28 has an open top 30 through which the circulating air can escape after being heated in channels 21.

Pipe 3 terminates below the open top 30 in a circular cap 7 integral with wall segments that are separated by slots 6 serving as exit apertures for the combustion gases evolving therein. The slots 6 lie above an upper end 5 of a solid pipe portion which extends over most of the height of the surrounding heat exchanger 10. The smoke channels of the latter are closed at the top by outwardly and downwardly sloping roof segments 25 merging into a flat, solid lid 23 which forms a protective plate overlying the cap 7 with slight spacing. Roof segments 25, which together with lid 23 prevent the rising combustion gases from escaping through the top 30 of wall 28, deflect these gases downward within channels 20 at whose lower ends they pass into an annular space 11 lying at the level of burner 2. Space 11, shown open at its bottom though it could also be closed, communicates with an exhaust 12 which may be connected to a chimney or flue not shown. The lower ends of air channels 21 are shielded from space 11 by downwardly and outwardly sloping bottom segments 26 extending into circumferentially continuous vertical wall segments 13 secured to the base 14.

As further shown in the drawing, I prefer to provide the combustion pipe 3 with one or more longitudinally extending peripheral folds 33, two in the present instance, enabling that pipe to expand under heat in the radial direction. The undulating jacket 15 can readily follow such expansion by a slight spreading of wall portions 19 bounding channels 20 at the locations of these folds.

As already noted, the heat exchanger 10 according to my invention may also operate without the outer wall 28 whereby channels 21 are fully exposed to the surrounding atmosphere.

The described and illustrated conicity of pipe 3 and jacket 15 takes into consideration the increasing density of the rising gases as they begin to cool, thus avoiding flow delays resulting therefrom. The undulations need not necessarily extend over the full length of heat exchanger 10, as where a different structure of the firebox 1 or of the base 14 requires their start at a higher level. The relative configuration of channels 20 and 21 can, of course, be modified, though I have found their described and illustrated shape to be particularly advantageous. It should further be noted that the space heater provided with my improved heat exchanger 10 could be laid on its side, e.g. as shown in the above-identified German publication DE-OS No. 21 39 504, so that terms such as "upper" and "lower" are to be understood only in a relative sense; the reference to "vertical" in conjunction with the pipe axis, therefore, also does not necessarily apply to the actual operating position.

I claim:

1. A space heater for small rooms, comprising:

a generally cylindrical combustion pipe, centered on a vertical axis and provided with an open lower end;

a burner entering said combustion pipe by said lower end;

a heat exchanger constituted by a jacket coaxially surrounding said combustion pipe, said jacket being of undulating cross-section over at least a major part of its height and forming a multiplicity of inwardly open first vertical channels alternating with as many outwardly open second vertical channels, said inwardly open first channels communicating near their upper ends with said combustion pipe and with their lower ends passing into an annular space completely surrounding said combustion pipe at the level of said burner and said jacket having a cylindrical circumferential wall defining said space and connected to an exhaust means for combustion gases, said outwardly open second channels communicating at least at their upper and lower ends with the surrounding atmosphere, said outwardly open second channels ending above said annular space and being separated from the inwardly open first channels and said annular space by outwardly sloping bottom segments, the cylindrical circumferential wall of said annular space being formed approximately in extension of outwardly directed boundaries of said jacket, said jacket being spacedly surrounded over at least part of its height by a generally cylindrical outer wall forming therewith an annular conduit open at the bottom and at the top to the surrounding atmosphere for enabling a circulation of ambient air through said second channels.

2. A space heater as defined in claim 1 wherein said first channels are narrower than said second channels.

3. A space heater as defined in claim 2 wherein said first channels are formed by substantially parallel wall portions of said jacket.

4. A space heater as defined in claim 1 wherein the undulations of said jacket have a radial depth ranging between substantially one-fifth and one-half of the outer radius thereof.

5. A space heater as defined in claim 1 wherein the upper ends of said first channels are closed by outwardly and downwardly sloping roof segments confronting lateral exit apertures of said combustion pipe whereby combustion gases leaving said pipe through said exit apertures are downwardly deflected into said first channels.

6. A space heater as defined in claim 5 wherein said roof segments are joined to a circular lid spacedly overlying the closed upper end of said combustion pipe.

7. A space heater as defined in claim 1 wherein said combustion pipe is in direct contact with the undulations of said jacket and separates said inner channels from one another.

8. A space heater as defined in claim 1 wherein said combustion pipe, said undulating jacket and said outer wall converge upwardly with a slight taper.

9. A space heater as defined in claim 6 wherein said combustion pipe is provided at said closed upper end with a protective plate screening said circular lid.

10. A space heater for small rooms, comprising:

a generally cylindrical combustion pipe centered on a vertical axis and provided with an open lower end;

a burner entering said combustion pipe by said lower end;

a heat exchanger constituted by a jacket coaxially surrounding said combustion pipe, said jacket being of undulating cross-section over at least a major part of its height and forming a multiplicity of inwardly open first vertical channels alternating with as many outwardly open second vertical channels, said inwardly open first channels communicating near their upper ends with said combustion pipe and with their lower ends passing into an annular space completely surrounding said combustion pipe at the level of said burner and said jacket having a cylindrical circumferential wall defining said space, said space being connected to an exhaust means for combustion gases, said outwardly open second channels communicating at least at their upper and lower ends with the surrounding atmosphere, said outwardly open second channels ending above said annular space and being separated from the inwardly open first channels and said annular space by outwardly sloping bottom segments, the cylindrical circumferential wall of said annular space being formed approximately in extension of outwardly directed boundaries of said jacket, said combustion pipe being provided with at least one longitudinally extending peripheral fold enabling thermal expansion thereof, said jacket being spacedly surrounded over at least part of its height by a generally cylindrical outer wall forming therewith an annular conduit open at the bottom and at the top to the surrounding atmosphere for enabling a circulation of ambient air through said second channels.

* * * * *